US009027181B1

(12) United States Patent
Yu

(10) Patent No.: US 9,027,181 B1
(45) Date of Patent: May 12, 2015

(54) FOLDABLE BED

(71) Applicant: Kuan-Chieh Yu, Changhua (TW)

(72) Inventor: Kuan-Chieh Yu, Changhua (TW)

(73) Assignees: Kuan-Chieh Yu, Changhua (TW); Chung-Hung Yu, Changhua (TW)

( * ) Notice: Subject to any disclaimer, the term of this patent is extended or adjusted under 35 U.S.C. 154(b) by 0 days.

(21) Appl. No.: 14/535,175

(22) Filed: Nov. 6, 2014

(51) Int. Cl.
*A47C 19/12* (2006.01)
*A47C 17/18* (2006.01)
*A47C 17/16* (2006.01)

(52) U.S. Cl.
CPC ..... *A47C 19/124* (2013.01); *A47C 17/18* (2013.01); *A47C 17/16* (2013.01)

(58) Field of Classification Search
CPC ..... A47C 19/12
USPC ..... 5/174, 177, 181, 201–202
See application file for complete search history.

(56) References Cited

U.S. PATENT DOCUMENTS

| | | | | |
|---|---|---|---|---|
| 1,221,856 | A * | 4/1917 | Hickson | 5/202 |
| 1,581,858 | A * | 4/1926 | Musgrave | 5/111 |
| 2009/0100597 | A1 * | 4/2009 | Oh | 5/176.1 |
| 2010/0005587 | A1 * | 1/2010 | Choi | 5/202 |
| 2010/0138994 | A1 * | 6/2010 | Lee et al. | 5/400 |
| 2012/0222216 | A1 * | 9/2012 | Jin | 5/400 |

* cited by examiner

*Primary Examiner* — Fredrick Conley
(74) *Attorney, Agent, or Firm* — Che-Yang Chen; Law Office of Michael Chen

(57) ABSTRACT

A foldable bed may include a first bed unit and a second bed unit. The first bed unit has a first bed frame and a second bed frame. Underneath the first and second bed frames are restorable leg and rear leg, so the first bed unit can be safely disposed on the ground. One side of the first and second bed frame has a first joint mechanism. The second bed unit has a first bed frame and a second bed frame, which are supported by a supporting leg, so the second bed unit can be safely disposed on the ground. A long slot on the first bed frame and second bed frame is provided for a securing unit to insert to connect with a connecting hole of the first joint mechanism, so the first bed unit and second bed unit can be connected as a foldable sofa bed.

10 Claims, 12 Drawing Sheets

FOLDABLE BED

FIELD OF THE INVENTION

The present invention is related to a foldable bed, and more particularly to a bed structure that has two foldable bed units that can be folded toward each other.

BACK GROUND OF THE INVENTION

A conventional sofa bed may include a bed frame (50), two corresponding rotating mechanism (51) fixed on both sides of the bed frame (50). A mattress can be disposed on two supporting frames (52) (53). When in use, the rotating mechanism (51) is operated so the second supporting frame (53) can be used as a back support for the first supporting frame (52). In another configuration, the first supporting frame (52) and second supporting frame (53) can be flatly disposed as a bed for sleep.

However, there are still some drawbacks for conventional sofa beds: even though the first supporting frame (52) and second supporting frame (53) can be operated as a sofa or bed, the first and second supporting frames (52) (53) are presented as a piece as a whole, so it cannot be bended itself and cannot be bended and restored with the bed frame (50), and the size of the sofa bed cannot be significantly reduced, which is not convenient for transporting and storing. Therefore, there remains a need for a new and improved folded sofa bed structure to overcome the problems stated above.

SUMMARY OF THE INVENTION

To overcome the problems stated above, the present invention provides a foldable bed that may include a first bed unit and a second bed unit, wherein the first bed unit has a first bed frame and a second bed frame. Underneath the first bed frame and second bed frame are restorable leg and rear leg for supporting purposes, so the first bed unit can be safely disposed on the ground. One side of the first bed frame and second bed frame is a first joint mechanism that has a fixed rod and a movable rod, and a ratchet wheel is used to connect the fixed rod and movable rod. An extension rod is hingedly attached to one side of the movable rod and a connecting hole is on the extension rod. The second bed unit has a first bed frame and a second bed frame, which are supported by a supporting leg, so the second bed unit can be safely disposed on the ground. A through hole is formed on the first bed frame and second bed frame for the extension rod and movable rod to insert. A long slot on the first bed frame and second bed frame is provided for a securing unit to insert to connect with the connecting hole of the first joint mechanism, so the first bed unit and second bed unit can be connected as a foldable sofa bed.

Comparing with the conventional structure, the present invention is advantageous because the bed units can be bended toward each other so the size thereof is significantly reduced, which is convenient for transporting and storing.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
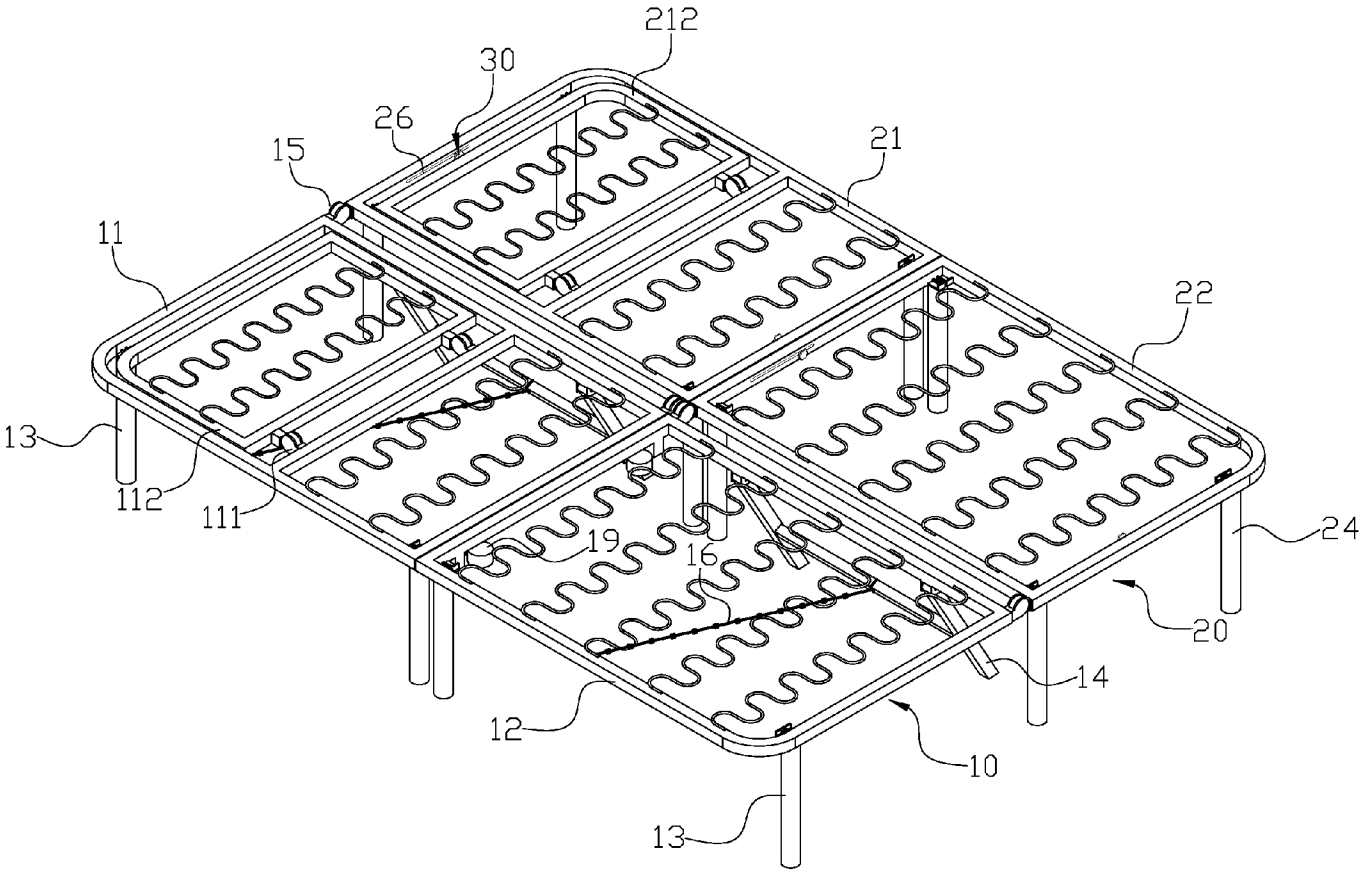
FIG. 1 illustrates a three-dimensional view of the present invention.
Figure 2:
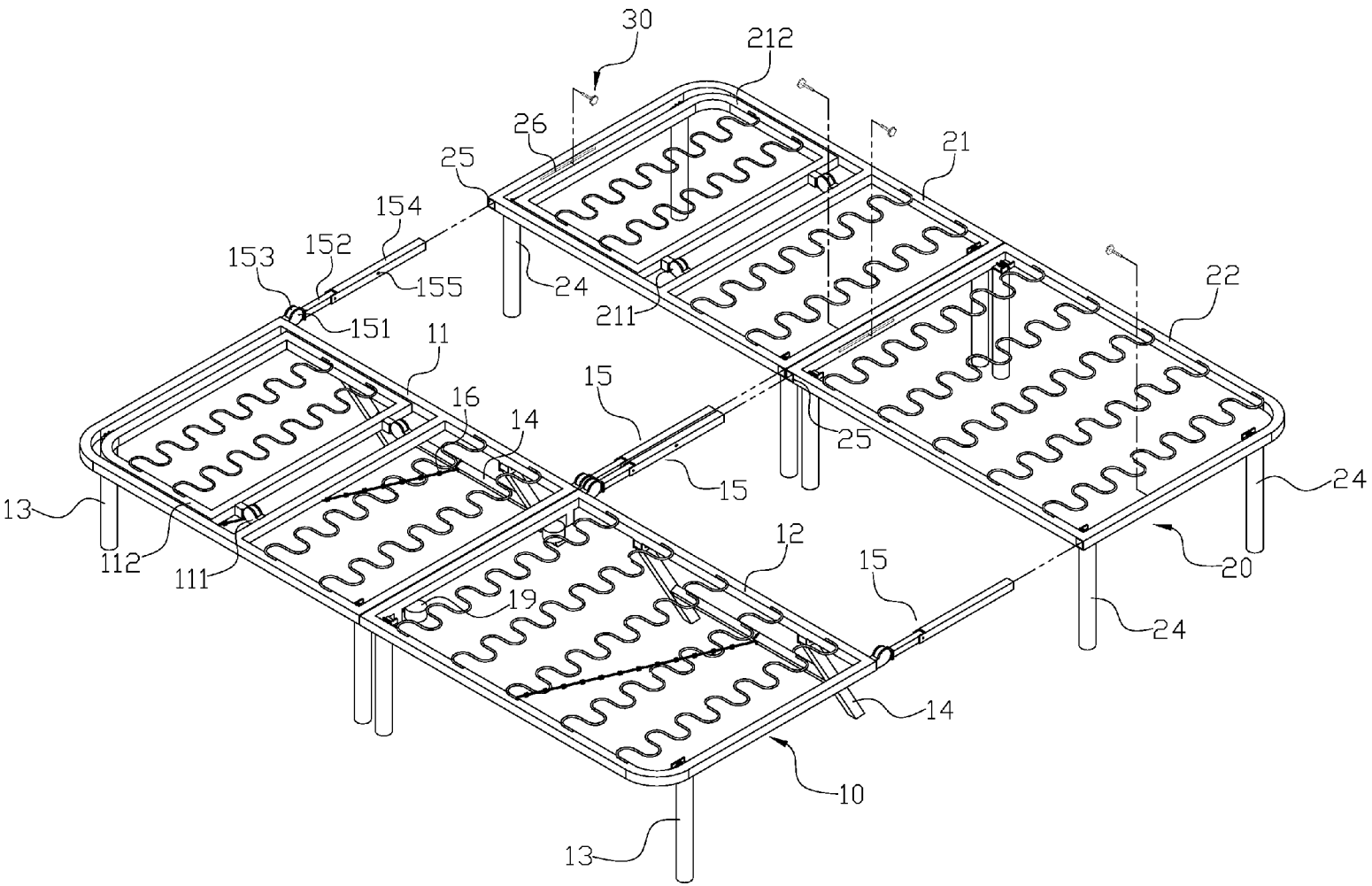
FIG. 2 illustrates a first exploded view of shelf of the present invention.

In order to further understand the goal, characteristics and effect of the present invention, a number of embodiments along with the drawings are illustrated as following:

Referring to FIGS. 1 to 2, a foldable bed may include a first bed unit (10) and a second bed unit (20), wherein the first bed unit (10) has a first bed frame (11) and a second bed frame (12). Underneath the first bed frame (11) and second bed frame (12) are restorable leg (13) and rear leg (14) for supporting purposes, so the first bed unit (10) can be safely disposed on the ground. One side of the first bed frame (11) and second bed frame (12) is a first joint mechanism (15) that has a fixed rod (151) and a movable rod (152), and a ratchet wheel (153) is used to connect the fixed rod (151) and movable rod (152). An extension rod (154) is hingedly attached to one side of the movable rod (152) and a connecting hole (155) is on the extension rod (154). The second bed unit (20) has a first bed frame (21) and a second bed frame (22), which are supported by a supporting leg (24), so the second bed unit (20) can be safely disposed on the ground. A through hole (25) is formed on the first bed frame (21) and second bed frame (22) for the extension rod (154) and movable rod (152) to insert. A long slot (26) on the first bed frame (21) and second bed frame (22) is provided for a securing unit (30) to insert to connect with the connecting hole (155) of the first joint mechanism (15), so the first bed unit (10) and second bed unit (20) can be connected as a foldable sofa bed.

In one embodiment, the first bed frame (11) (21) of the first bed unit (10) and the second bed unit (20) has a bendable moving frame (112) (212) hingedly connected to a second joint mechanism (111) (211) as to a person's head portion.

In another embodiment, a pulling unit (16) is formed between the first bed frame (11) and second bed frame (12) of the first bed unit (10) and the rear leg (14). The pulling unit (16) is used to prevent the rear leg (14) to collapse when supporting a heavy weight. The pulling unit (16) can be a cable or a bendable long rod.

Figure 4:
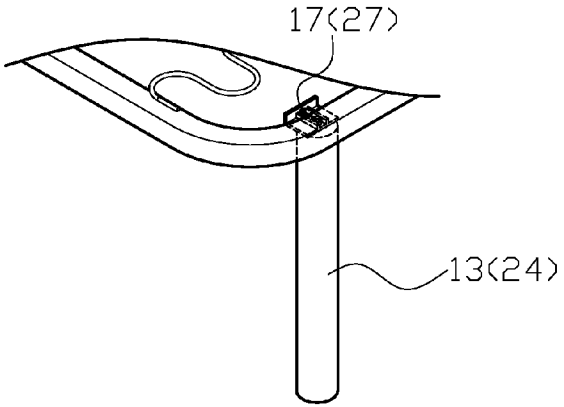
FIG. 4 illustrates a schematic view of the leg when it is loosened in the present invention.
Figure 5:
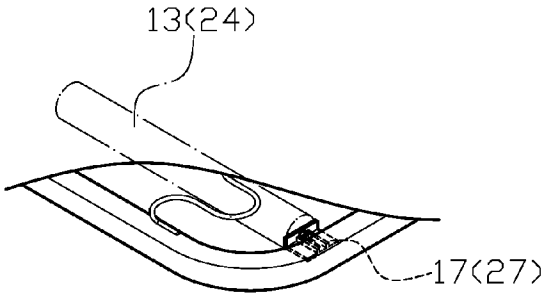
FIG. 5 illustrates a schematic view of the leg when it is restored in the present invention.
Figure 3:
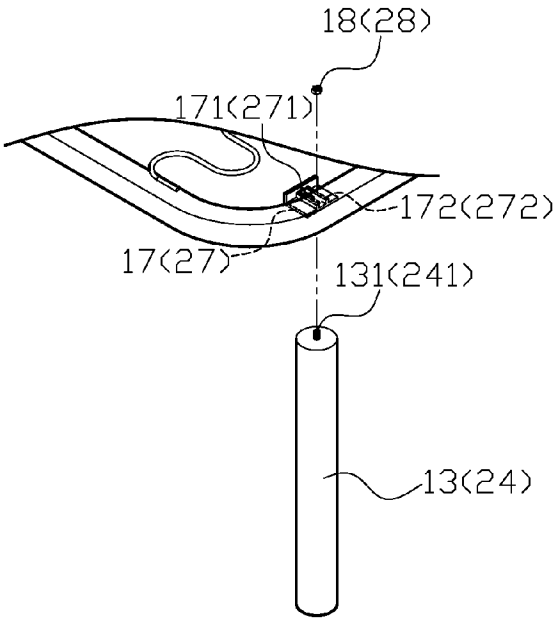
FIG. 3 illustrates an exploded view of the leg of the present invention.

In a further embodiment, a predetermined number of fixing pieces (17) (27) are disposed on the first bed frame (11) (21) and second bed frame (12) (22) of the first bed unit (10) and second bed unit (20) (see FIGS. 3 to 5). An L-shaped groove (171) (271) of the fixing pieces (17) (27) are provided for screws (131) (141) of the restorable leg (13) and the supporting leg (24) to connect with the nuts (18) (28) on top of the fixing pieces (17) (27). So, the restorable leg (13) and the supporting leg (24) can be controlled, and the nuts (18) (28) are restricted by two protruding units (172) (272) of the fixing pieces (17) (27) to prevent idling rotation when the restorable leg (13) and the supporting leg (24) are moving.

In still a further embodiment, the first bed frame (11) and second bed frame (12) of the first bed unit (10) have at least a wheel (19) on the sideway. In still a further embodiment, each of the first bed unit (10) and second bed unit (20) has a mattress.

Figure 6:
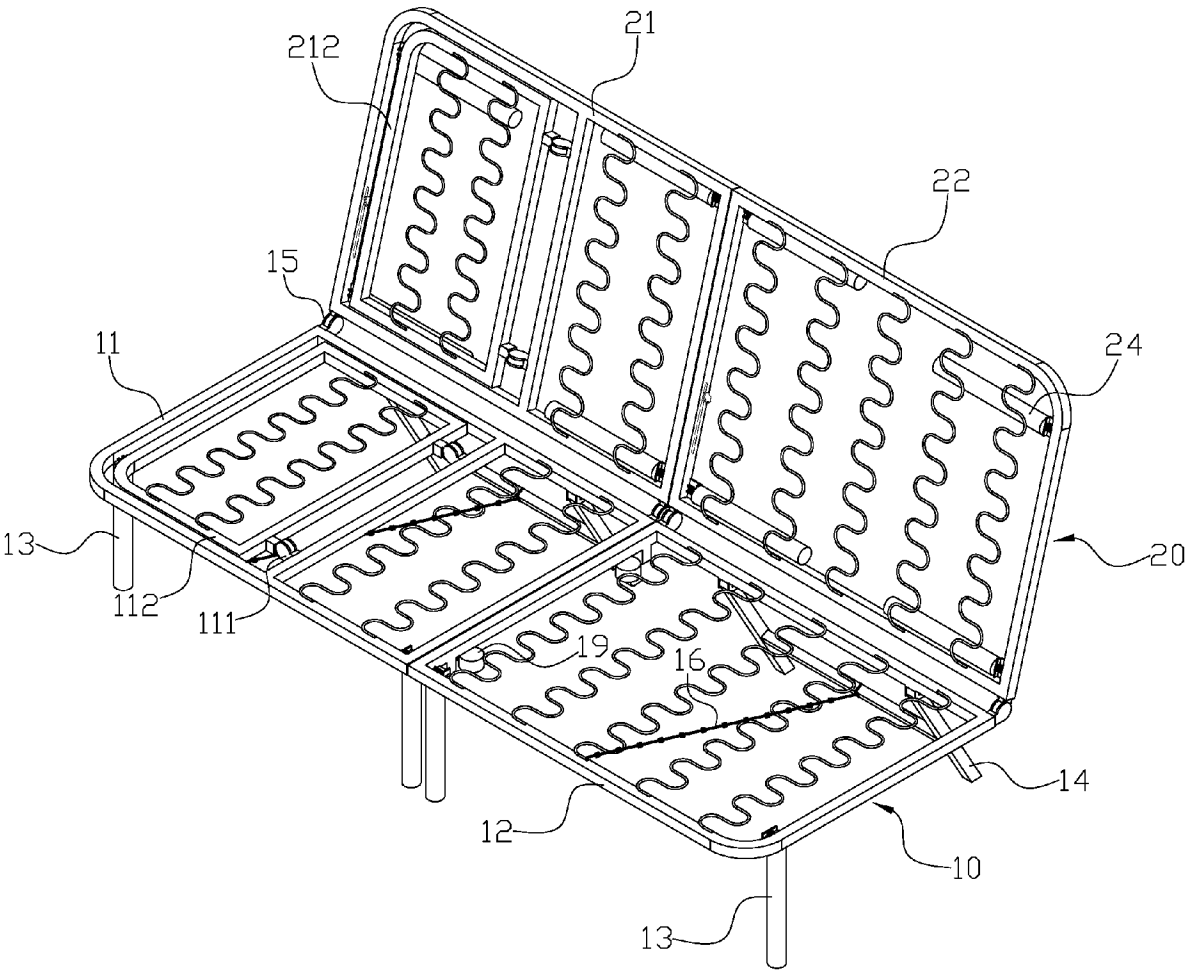
FIG. 6 illustrates a three-dimensional view of a sofa converted from the bed in the present invention.
Figure 7:
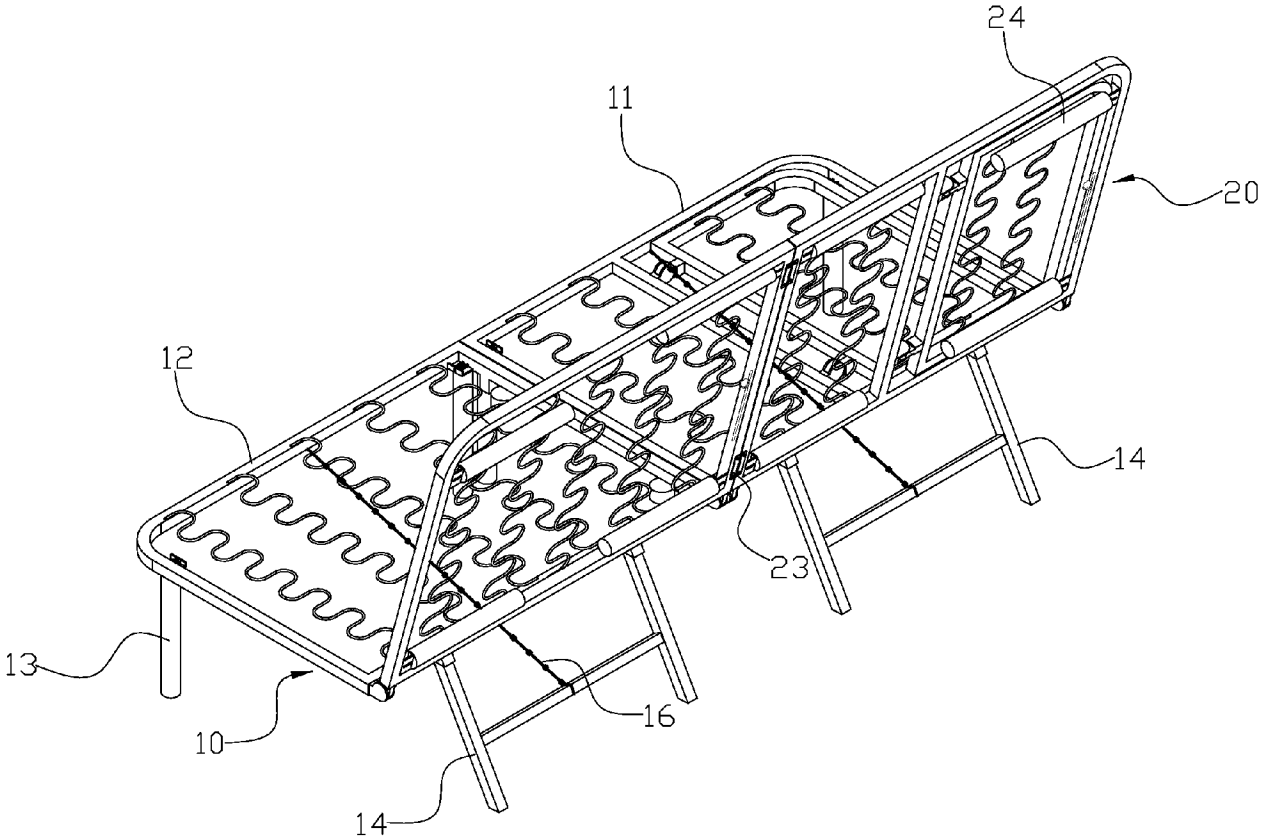
FIG. 7 illustrates a three-dimensional view of the sofa converted from the bed from another angle in the present invention.
Figure 8:
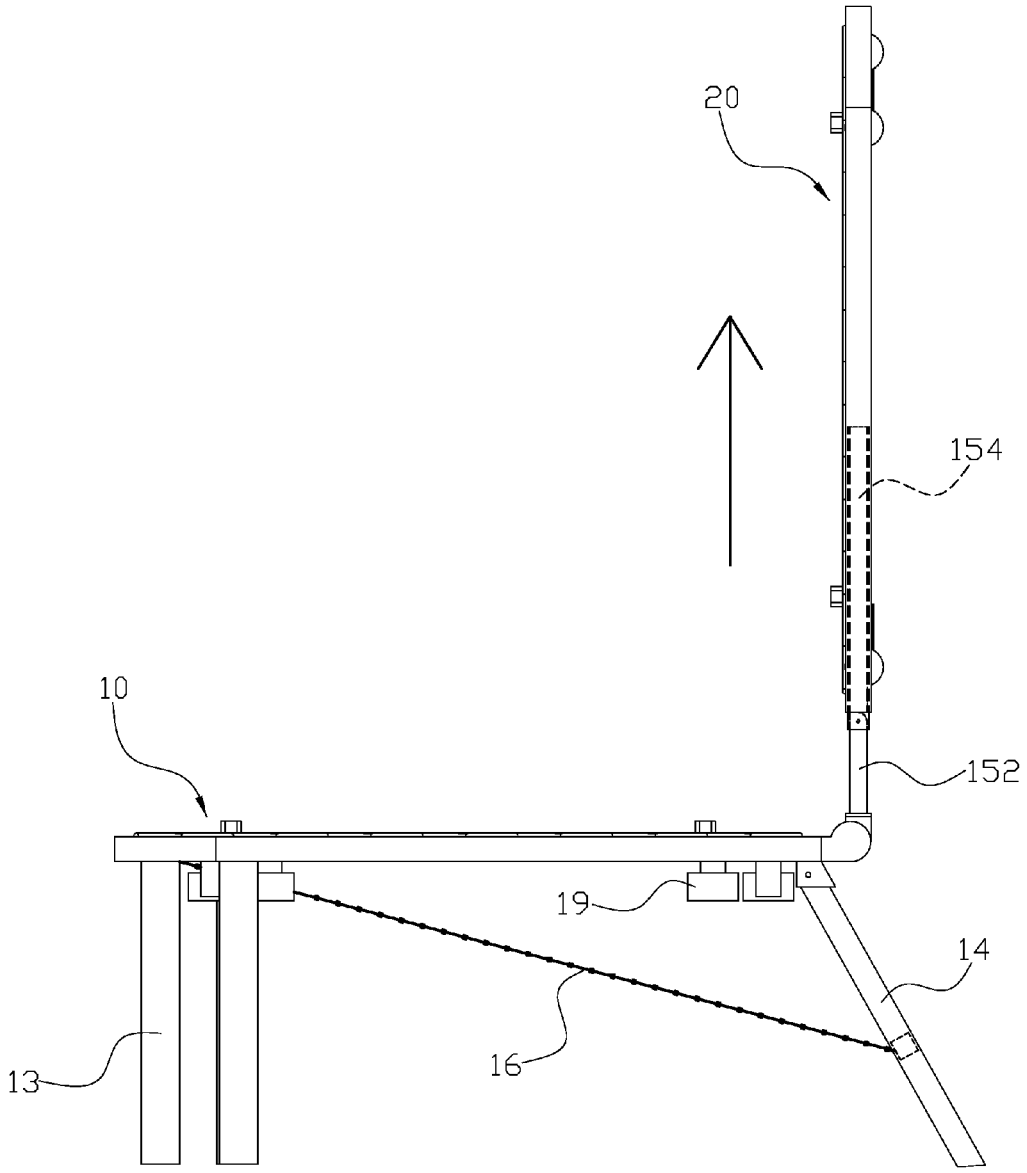
FIG. 8 illustrates a schematic view of the second bed unit which is pulled up in the present invention.
Figure 9:
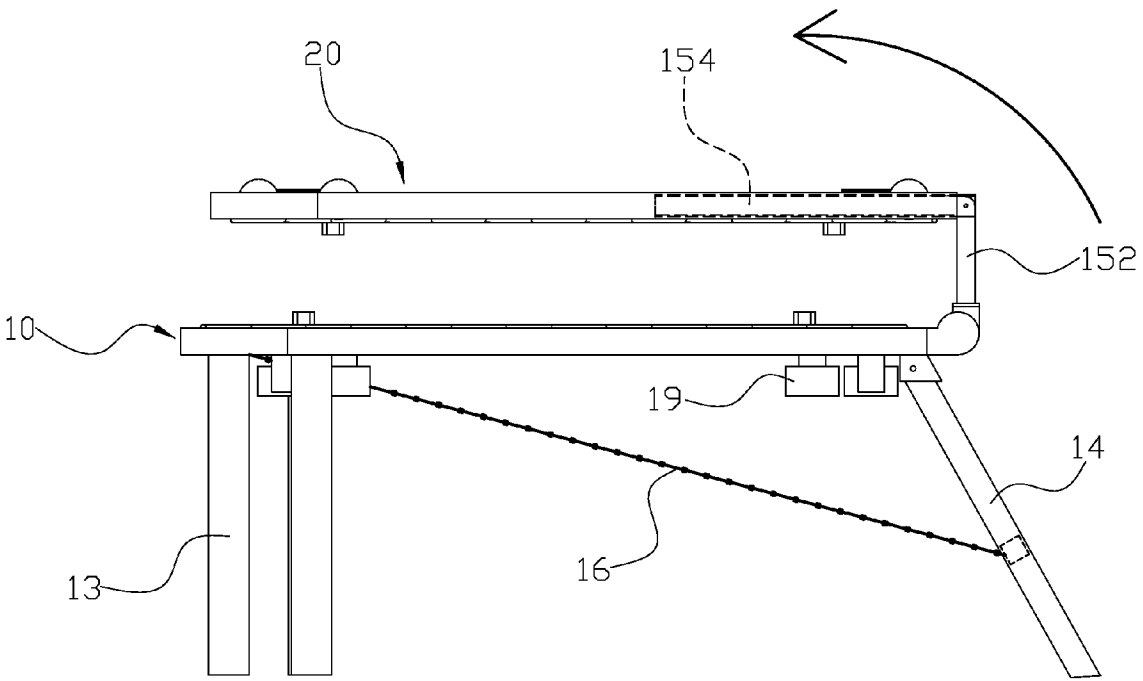
FIG. 9 illustrates a two-dimensional view of the second bed unit bended toward the first bed unit in the present invention.
Figure 10:
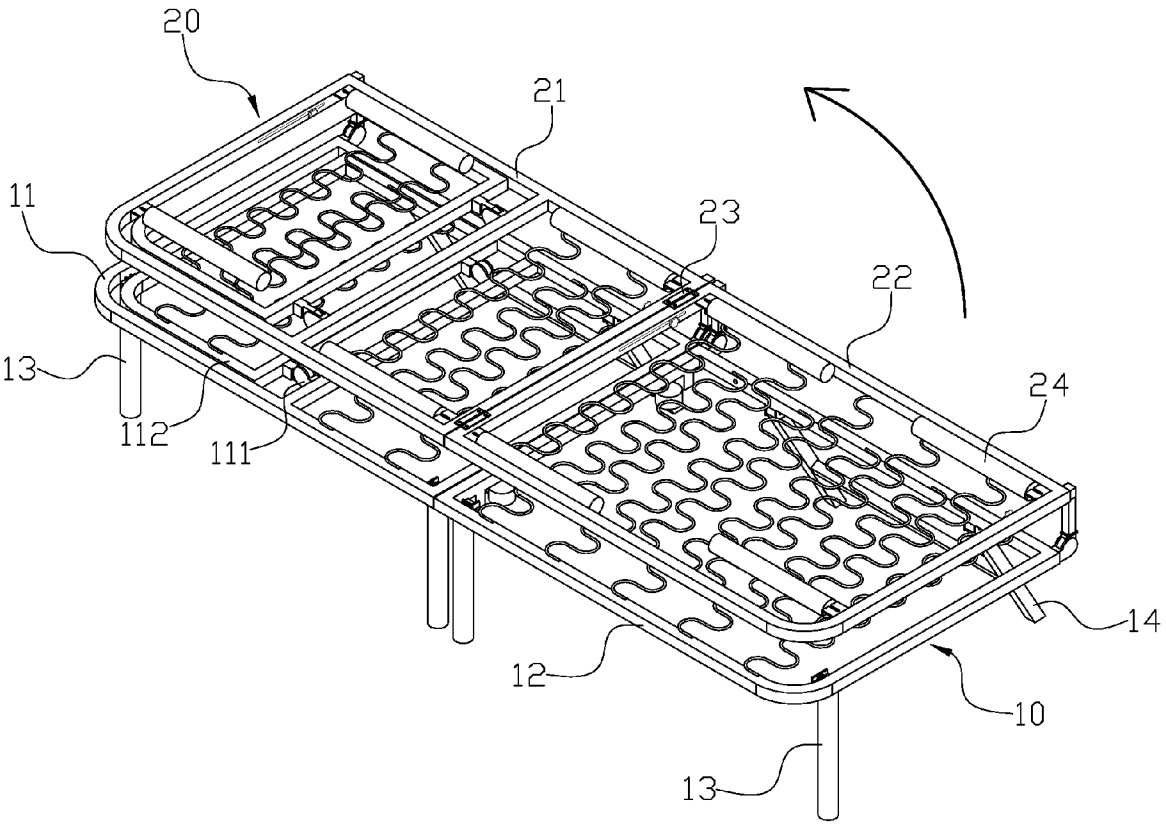
FIG. 10 illustrates a three-dimensional view of the second bed unit bended toward the first bed unit in the present invention.
Figure 11:
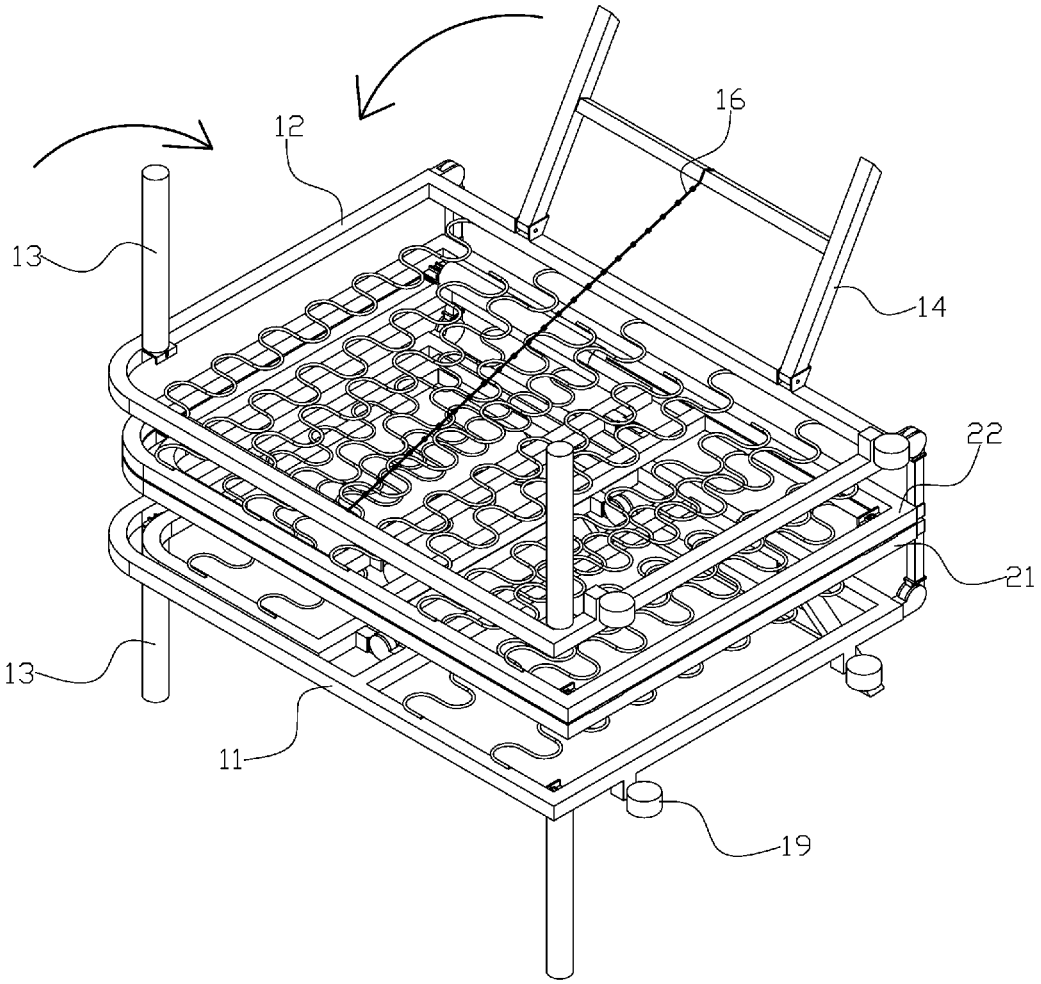
FIG. 11 illustrates a schematic view of the first bed frame and the second bed frame bended toward each other.
Figure 12:
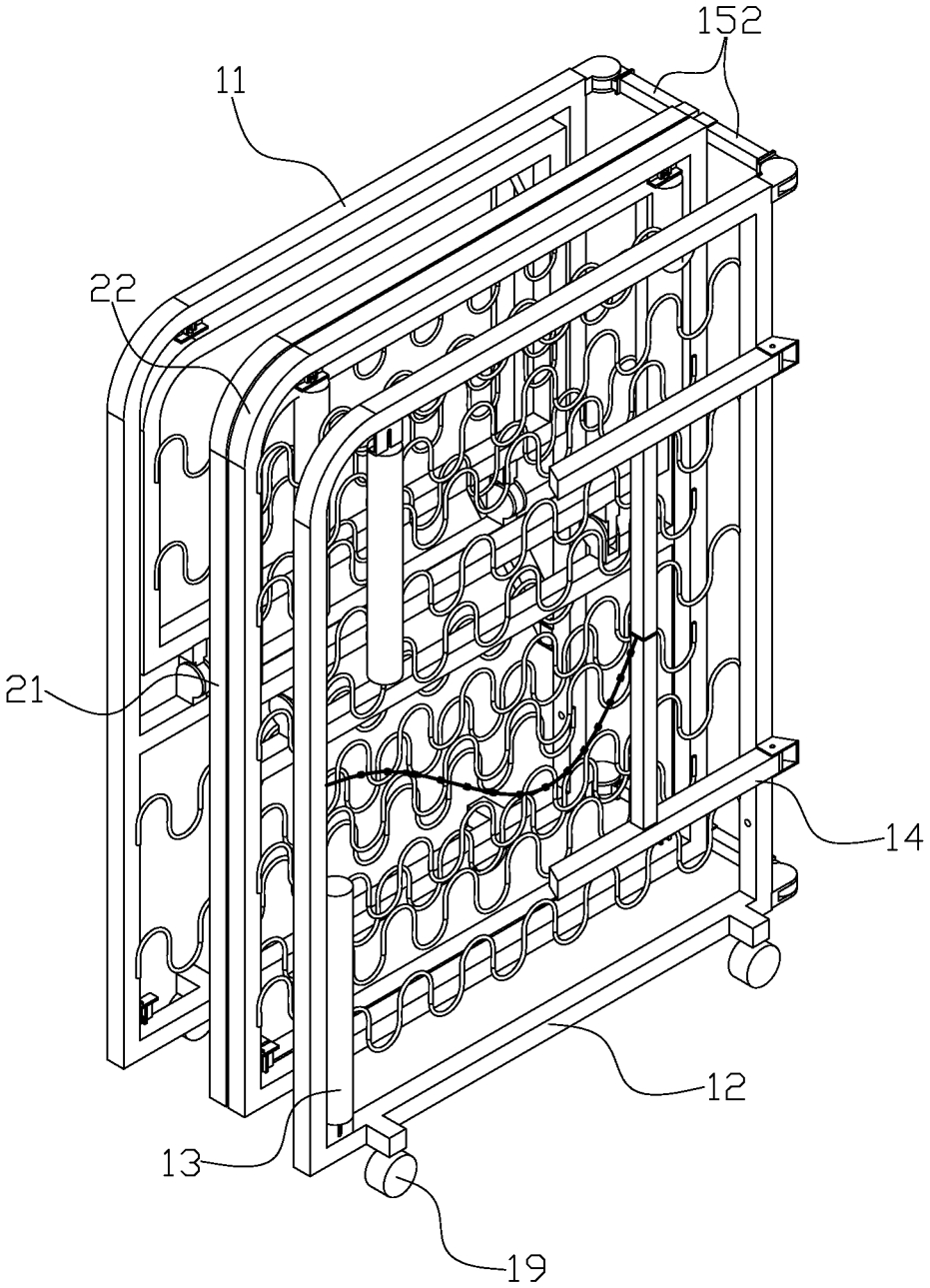
FIG. 12 illustrates a three-dimensional view of the bed which is completed folded in the present invention.

When in use, the first bed unit (10) and second bed unit (20) are fully extended (see FIG. 1), so the user can lay down on first bed unit (10) and second bed unit (20). Through the bendable moving frame (112) (212), the user can adjust the angle of the head portion until he/she is satisfied. When the user wants to convert the foldable bed into a sofa (see FIGS. 6 and 7), he/she can use the first joint mechanism (15) to lift the second bed unit (20) and use it as a back of the sofa, and with the support of the rear leg (14) and the pulling unit (16) to prevent the collapse of the back of the sofa.

Referring to FIGS. 8 to 12, when the bed is folded, the securing unit (30) has to be loosened, so the second bed unit (20) can be lifted to the extent defined by the long slot (26) and the second bed unit (20) can be moved out from the movable rod (152) of the first joint mechanism (15). Due to the thickness of the mattress, the second bed unit (20) can be bended toward the first bed unit (10), so the two bed units are disposed side by side but not connected. Since the first bed frame (10) and the second bed frame (20) of the first bed unit (10) and the second bed unit (20) are hingedly connected with each other, the first bed frame (11) (21) and the second bed frame (12) (22) can be bended and then moved by the wheel (19). When the restorable leg (13) and the supporting leg (24) are both taken inside, the first bed unit (10) and second bed unit (20) are completely restored.

Figure 13:
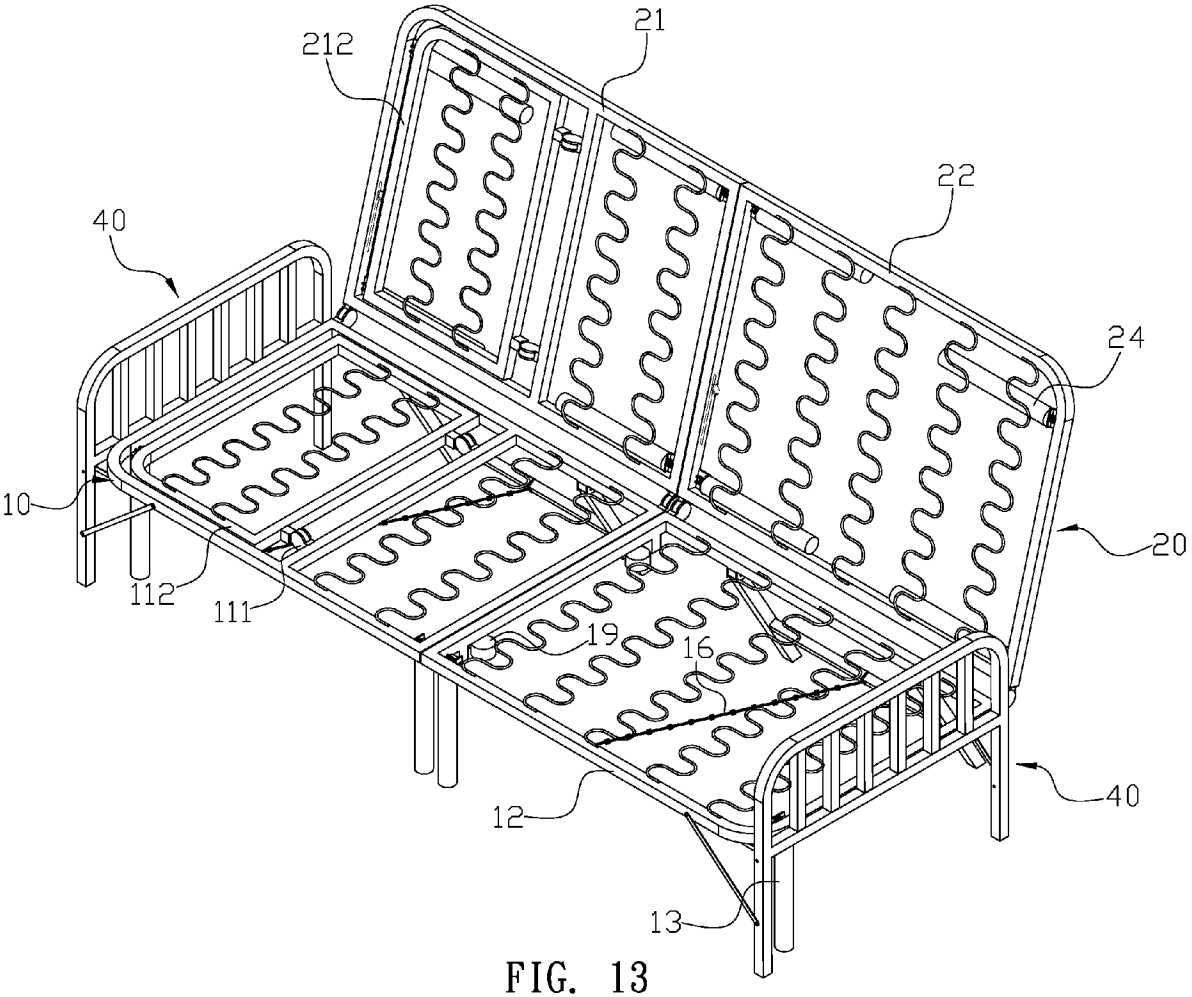
FIG. 13 illustrates an armrest in the present invention.
Figure 14:
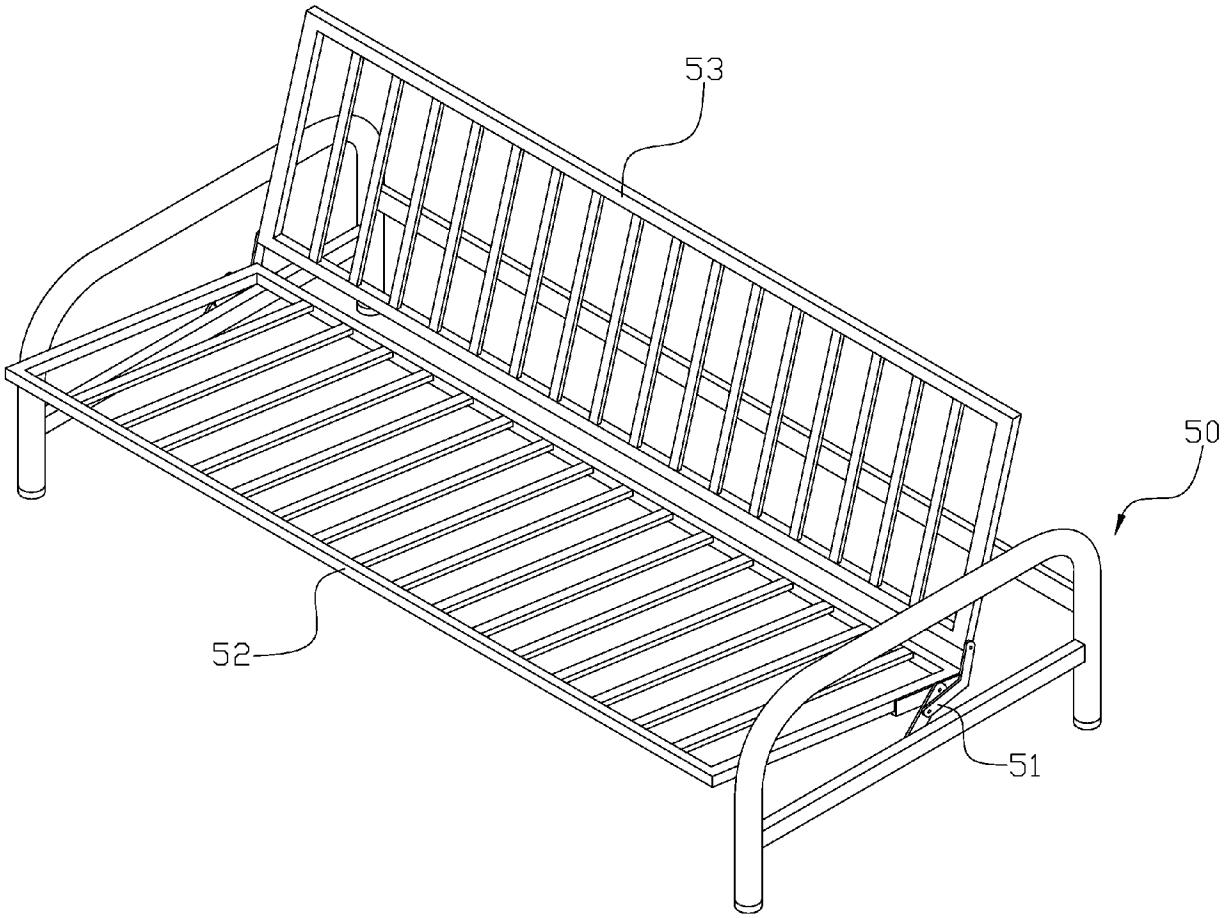
FIG. 14 PRIOR ART
FIG. 14 illustrates a prior art.

Referring to FIG. 13, at least one of the first bed unit (10) and second bed unit (20) has a foldable armrest (40).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A foldable bed comprising a first bed unit and a second bed unit, wherein the first bed unit has a first bed frame and a second bed frame, and underneath the first bed frame and second bed frame are restorable leg and rear leg for supporting purposes, so the first bed unit is safely disposed on the ground; one side of the first bed frame and second bed frame has a first joint mechanism that has a fixed rod and a movable rod, and a ratchet wheel is used to connect the fixed rod and movable rod, and an extension rod is hingedly attached to one side of the movable rod and a connecting hole is formed on the extension rod, wherein the second bed unit has a first bed frame and a second bed frame, which are supported by a supporting leg, so the second bed unit is safely disposed on the ground; a through hole is formed on the first bed frame and second bed frame for the extension rod and movable rod to insert and a long slot on the first bed frame and second bed frame is provided for a securing unit to insert to connect with the connecting hole of the first joint mechanism, so the first bed unit and second bed unit are connected as a foldable bed.

2. The foldable bed of claim 1, wherein the first bed frames of the first bed unit and the second bed unit have bendable moving frames hingedly connected to a second joint mechanism.

3. The foldable bed of claim 1, wherein a pulling unit is formed between the first bed frame and second bed frame of the first bed unit and the rear leg.

4. The foldable bed of claim 3, wherein pulling unit is a cable.

5. The foldable bed of claim 3, wherein pulling unit is a bendable rod.

6. The foldable bed of claim 1, wherein a predetermined number of fixing pieces are disposed on the first bed frame and second bed frame of the first bed unit and second bed unit, and an L-shaped groove of the fixing pieces are provided for screws of the restorable leg and the supporting leg to connect with the nuts on top of the fixing pieces, so the restorable leg and the supporting leg are controlled, and the nuts are restricted by two protruding units of the fixing pieces.

7. The foldable bed of claim 1, wherein the first bed frame and second bed frame of the first bed unit have at least a wheel on the sideway.

8. The foldable bed of claim 1, wherein a mattress is provided for the first bed unit and second bed unit.

9. The foldable bed of claim 1, wherein the securing unit is a screw.

10. The foldable bed of claim 1, at least one of the first bed unit and second bed unit has a foldable armrest.

* * * * *